US011891724B2

(12) United States Patent
Park et al.

(10) Patent No.: US 11,891,724 B2
(45) Date of Patent: Feb. 6, 2024

(54) ELECTROSPINNING APPARATUS FOR PRODUCING ULTRAFINE FIBERS HAVING IMPROVED CHARGED SOLUTION CONTROL STRUCTURE AND SOLUTION TRANSFER PUMP THEREFOR

(71) Applicant: Jong-Su Park, Seoul (KR)

(72) Inventors: Jong-Su Park, Seoul (KR); Woong Huh, Incheon (KR); Youn-Chang Lee, Seoul (KR); Woong-June Hwang, Incheon (KR)

(73) Assignee: Jong-Su Park, Seoul (KR)

( * ) Notice: Subject to any disclaimer, the term of this patent is extended or adjusted under 35 U.S.C. 154(b) by 694 days.

(21) Appl. No.: 15/733,762

(22) PCT Filed: Apr. 5, 2019

(86) PCT No.: PCT/KR2019/004024

§ 371 (c)(1),
(2) Date: Oct. 19, 2020

(87) PCT Pub. No.: WO2019/203483

PCT Pub. Date: Oct. 24, 2019

(65) Prior Publication Data

US 2021/0156050 A1 May 27, 2021

(30) Foreign Application Priority Data

Apr. 19, 2018 (KR) ..... 10-2018-0045660
Apr. 19, 2018 (KR) ..... 10-2019-0036242

(51) Int. Cl.
*D01D 5/18* (2006.01)
*D01D 5/00* (2006.01)
(Continued)

(52) U.S. Cl.
CPC ..... *D01D 5/0069* (2013.01); *F04B 17/03* (2013.01); *F04B 23/02* (2013.01); *D01D 5/0007* (2013.01); *D01D 5/18* (2013.01); *F04B 49/10* (2013.01)

(58) Field of Classification Search
CPC .. D01D 5/0092; D01D 5/0985; D01D 5/0076; D01D 5/0023; D01D 5/0069;
(Continued)

(56) References Cited

U.S. PATENT DOCUMENTS

2002/0122840 A1* 9/2002 Lee ..... D01D 5/0061 425/174.6
2008/0237934 A1* 10/2008 Reneker ..... D01D 5/0069 425/174
(Continued)

FOREIGN PATENT DOCUMENTS

JP 2002-201559 A 7/2002
JP 2005-264401 A 9/2005
(Continued)

OTHER PUBLICATIONS

Decision to Grant a Patent received for Japanese Application No. 2020-556880, dated Apr. 5, 2022, 5 pages (2 pages of English translation and 3 pages of Original Document).
(Continued)

*Primary Examiner* — Joseph S Del Sole
*Assistant Examiner* — Margaret B Hayes
(74) *Attorney, Agent, or Firm* — Wolter Van Dyke Davis, PLLC; Eugene J. Molinelli; Cian O'Brien

(57) ABSTRACT

An electrospinning apparatus for producing ultrafine fibers according to the present invention comprises: a cylindrical metal guide disposed to surround a hollow tube needle, which receives a charged solution and discharges the charged solution in the form of a filament, wherein a high
(Continued)

voltage is applied to the cylindrical metal guide to control droplet stability of the charged solution; and a strip-shaped metal guide including a plurality of strip-shaped metal plates, which extend outward from the cylindrical metal guide and are radially arranged to control the direction of a charged filament, whereby discharge droplets of the charged solution are stably maintained, and the charged filament formed therefrom maintains a constant directionality with respect to a substrate, so that a uniform pattern having ultrafine fibers can be manufactured on a collection part.

18 Claims, 10 Drawing Sheets

(51) Int. Cl.
*F04B 17/03* (2006.01)
*F04B 23/02* (2006.01)
*F04B 49/10* (2006.01)

(58) Field of Classification Search
CPC ..... D01D 13/00; D01D 5/18; D01D 5/0061; D01D 5/0007; D01D 5/00; B29C 41/04; B29C 41/045; B29C 41/06; B29C 41/50; B29C 34/08; B29C 64/241; B28B 21/30; B28B 21/80; D04H 1/728; B22D 13/06; B04B 7/08
USPC ..... 425/8, 9
See application file for complete search history.

(56) References Cited

U.S. PATENT DOCUMENTS

2008/0307766 A1* 12/2008 Petras ..... D01D 5/0069 57/402
2010/0072674 A1* 3/2010 Takahashi ..... D01D 5/0069 977/840
2014/0331455 A1* 11/2014 Stylios ..... D01D 5/0092 425/8
2015/0071472 A1* 3/2015 Lee ..... D01F 1/04 381/334

FOREIGN PATENT DOCUMENTS

| | | | |
|---|---|---|---|
| JP | 2010-121238 | A | 6/2010 |
| JP | 2012-207351 | A | 10/2012 |
| KR | 10-2002-0051066 | A | 6/2002 |
| KR | 10-2002-0078706 | A | 10/2002 |
| KR | 10-2008-0008397 | A | 1/2008 |
| KR | 10-2014-0026803 | A | 3/2014 |
| KR | 10-2017-0049790 | A | 5/2017 |
| KR | 101965395 | B1 | 4/2019 |

OTHER PUBLICATIONS

International Preliminary Report on Patentability received for PCT Patent Application No. PCT/KR2019/004024, dated Oct. 29, 2020, 18 pages (12 pages of English Translation and 6 pages of Original Document).
International Search Report and Written Opinion received for PCT Patent Application No. PCT/KR2019/004024, dated Jul. 25, 2019, 20 pages (11 pages of English translation and 9 pages of Original Document).
Supplementary European search report and Search Opinion received for EP Patent Application No. 19789160.9, dated Jan. 11, 2022 8 pages.
Kim, et al.; "Stability analysis for multi-jets electrospinning process modified with a cylindrical electrode"; European Polymer Journal, vol 42, 2006, pp. 2031-2038.

* cited by examiner

FIG. 10

| Experiment condition | | | Example | Comparative example 1 | Comparative example 2 |
|---|---|---|---|---|---|
| Nozzle specification | High voltage magnitude | Droplets jet quantity | | | |
| 23G | 12KV | 25 μℓ /min | 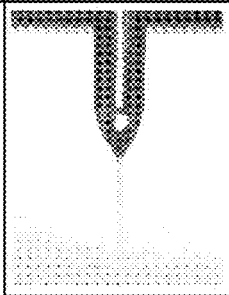 | 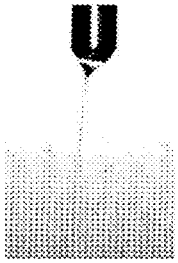 | 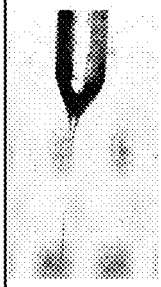 |
| | | | Stable | Unstable (jet rotation) | Unstable (inclined jet rotation) |
| 23G | 14.5KV | 50 μℓ /min | 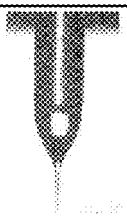 | 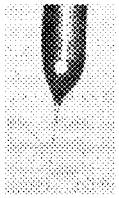 | 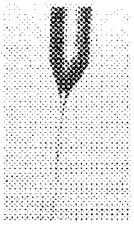 |
| | | | Stable | Unstable (jet rotation) | Unstable (inclined jet) |
| 23G | 20KV | 150 μℓ /min | 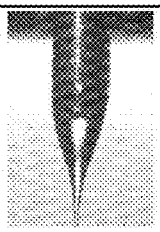 | 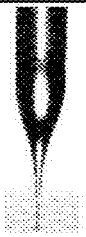 | 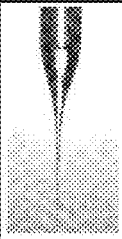 |
| | | | Stable | Unstable (rapid cycle undulation) | Unstable (rapid cycle undulation) |
| 23G | 25KV | 500 μℓ /min | 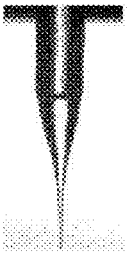 | 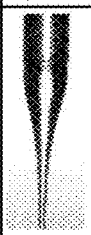 | 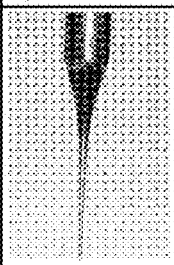 |
| | | | Stable | Unstable (rapid cycle undulation) | Unstable (rapid cycle undulation) |

ELECTROSPINNING APPARATUS FOR PRODUCING ULTRAFINE FIBERS HAVING IMPROVED CHARGED SOLUTION CONTROL STRUCTURE AND SOLUTION TRANSFER PUMP THEREFOR

TECHNICAL FIELD

The present application is a 371 national stage application of PCT Application No. PCT/KR2019/004024, filed Apr. 5, 2019, and claims the benefit of Korean Patent Application No. 10-2018-0045660 filed on Apr. 19, 2018 and Korean Patent Application No. 10-2019-0036242 filed on Mar. 28, 2019 with the Korean Intellectual Property Office, the disclosure of which is incorporated herein by reference in its entirety.

The present disclosure relates to an electrospinning apparatus for producing ultrafine fibers and a solution transfer pump therefor, and more particularly, to an electrospinning apparatus for producing ultrafine fibers having a structure capable of producing ultrafine fibers in a uniform pattern by controlling the orientation of charged filaments and a solution transfer pump therefor.

BACKGROUND ART

In general, electrospinning is a process of producing nanofibers using an apparatus that applies a direct current high voltage of a few thousands to a few tens of thousands of volts (+) to a polymer solution, and connects the ground or (−) voltage to a collector that collects charged filaments to form an electric field. In this instance, a very small amount of charged droplets jetting through a nozzle form ultrafine fibers of nanometer (nm)~micrometer (μm) diameter when they are subjected to elongation in the lengthwise direction by the electric power.

In the electrospinning process, the high voltage magnitude applied to the solution is differently set depending on the type of the polymer solution or the nanofiber production condition. At a nozzle tip-to-collector distance (TCD, indicated in cm), in the case of a poly(vinylidene fluoride) (PVDF), poly(acrylonitrile) (PAN) or (poly(vinylpyrrolidone) (PVP) polymer solution, the applied high voltage magnitude is 0.5~1.5 kV/cm, in the case of a poly(vinylalcohol) (PVA) polymer aqueous solution, 1.5~2 kV/cm, and in the case of a chitosan polymer solution, 3~5 kV/cm.

The ultrafine fibers produced by the electrospinning process are collected and stacked in the collector to produce a microporous membrane, or coated on a predetermined substrate in the form of a thin film. Additionally, the process of forming ultrafine fibers may be applied to the fabrication of linear circuits.

The charged filaments that form nanofibers in the electrospinning process are produced from the charged solution jetting from a hollow needle (the nozzle) under the applied high voltage, or a solution coated in the form of a thin film on a roll or a wire to which a high voltage is applied.

In the case of the electrospinning process using the nozzle, according to the process of forming the charged filaments from droplets jetting from the nozzle, when a higher electric power than the surface tension of the solution is applied, the droplets of the charged solution jetting from the nozzle are formed in a conical shape at the nozzle tip, and the conical portion forms charged filaments by elongation in the lengthwise direction toward the collector. In this instance, the conical shape formed at the nozzle tip is referred to as Taylor cone, and the filaments elongated in the lengthwise direction are referred to as jet. The jet formed from the conical portion of the Taylor cone produces nanofibers through sharp fluctuations (whipping mode) and a solvent volatilization process at an arbitrary point with the higher electric power.

As the high voltage magnitude is stronger, and as the solvent volatility is stronger, the conical Taylor cone becomes more unstable at the nozzle tip. When the Taylor cone is unstable, the charged filament jet formed therefrom does not maintain the orientation and becomes unstable. When the Taylor cone is unstable at the nozzle tip, uniform collection at the same location of the collector is impossible. Additionally, it is difficult to repeatedly produce ultrafine fibers uniformly on the substrate, failing to manufacture a web having the same shape or size.

Additionally, when making a core-shell structure using a concentric dual nozzle, in case that the Taylor cone formed at the nozzle tip is unstable, the conical shape is not properly formed, failing to making the structure in a uniform shape.

In the electrospinning process, when the surrounding spinning environment is asymmetrical, the charged filaments are affected by the position of the nozzle, and thus it is impossible to form a uniform pattern on the substrate.

In the electrospinning process, a solution storage tank chiefly uses a syringe having a rod-type plunger or a barrel having an inner plunger. The solution filled in the syringe or the barrel is transferred to the nozzle by the operation of a solution transfer device including a stepping motor and a pusher, or the solution is quantitatively transferred by injection of air or gas. In this instance, the application of high voltage to the solution is performed through the nozzle. However, the conventional method of applying high voltage to the nozzle has a problem with the inclined spreading direction of jet droplets due to the electric field asymmetry at the nozzle tip.

Additionally, in the case of spinning at a long nozzle tip-to-collector distance, when the high voltage magnitude increases, the droplets of the conical Taylor cone formed at the nozzle tip are in an unstable state at the nozzle tip, for example, severe swing or inclined orientation. When spinning droplets are unstable, the jet of charged filaments formed therefrom is collected in the collector without uniform orientation, so it is difficult to manufacture a nanofiber film having a uniform thickness. Additionally, when the polymer solution has high viscosity or high surface tension, it is necessary to increase the high voltage magnitude when producing nanofibers, and in this case, when the magnitude of the high voltage increases, the solution jetting from the nozzle is not uniformly spun, failing to collect nanofibers at a predetermined area. Additionally, when multiple nozzles are used, each of charged filaments jetting from the nozzles pushes each other due to the repulsion of the charges, resulting in unstable spinning at the nozzles positioned at two ends. Additionally, when spinning using two types of solutions, for example, when making a core-shell dual-layer structure, since the optimal high voltage magnitude is different, the Taylor cone formed at the nozzle tip may be spun in a non-uniform distribution. In this case, due to the non-uniformity of the core and the shell, it is difficult to produce uniform core-shell dual-layer nanofibers.

When the high voltage magnitude increases, the syringe mounted on the solution transfer device undergoes dielectric breakdown to form a high voltage electric field around a pump, and the control circuit of the solution transfer device turns into a control disable state due to an electrical shock caused by an instantaneous short circuit. As the high voltage magnitude increases, this problem occurs more frequently.

Particularly, a short circuit occurs in the metal case of the syringe pump from the metal nozzle mounted outside or inside of the syringe in a high voltage environment of 20 kV or more. In a high voltage environment, the syringe mounted in the solution transfer device undergoes dielectric breakdown to form a high voltage electric field around the pump, and the control circuit of the solution transfer device turns into a control disenable state due to an electrical shock caused by an instantaneous short circuit.

Patent Literature 1 (Korean Patent Publication No. 2004-0016320) discloses providing a multi-nozzle configuration to stably discharge filaments, and a spinning nozzle pack to stably discharge a charged solution without electrical interaction with the collector, wherein a jet stream control unit formed in the shape of a conductor plate or a conductor stick is installed on both sides or both longitudinal sides with respect to the spinning nozzle pack P to control the spreading in the outward direction of the spinning nozzle pack P due to the repulsion between the charged filaments with the same polarity.

Additionally, Patent Literature 2 (Korean Patent Publication No. 2002-0051066) discloses a charge distribution plate, i.e., a metal plate having holes that are slightly larger in size than the nozzle. The individual nozzles are inserted into each hole of the charge distribution plate to create an identical or equal charged environment of each nozzle. Accordingly, it is possible to prevent phenomena in which the jet goes out of the area of the collector since the fibrous polymer jetting from each nozzle pushes each other by repulsion due to interference, or a film of a non-uniform thickness is formed by the non-uniform jet for each nozzle due to the different environments of the capillary nozzles.

However, the jet stream control unit of Patent Literature 1 or the charge distribution plate of Patent Literature 2 cannot individually control the conical droplets (the Taylor cone) formed at the nozzle tip of the individual nozzle or the charged filaments extending from the droplets, or control the direction of the charged filaments (jet) formed from the Taylor cone. Accordingly, it is impossible to freely form a pattern of a desired shape (for example, a grid-shaped pattern) by uniformly collecting nanofibers in the limited area of the collector by virtue of the Taylor cone and the jet kept in a stable state without inclined orientation at the nozzle tip in a high voltage environment of 10 kV or more.

DISCLOSURE

Technical Problem

The present disclosure is designed to address the above-described issue, and therefore the present disclosure is directed to providing an electrospinning apparatus for producing ultrafine fibers, in which nanofibers are uniformly collected in the limited area of a collector by controlling the droplets stability of a charged solution formed at the nozzle tip and the direction of the charged filaments formed therefrom under a high voltage environment of a few tens of thousands volts, thereby freely forming a pattern of a desired shape (for example, a grid-shaped pattern or circuit), and a solution transfer pump therefor.

The present disclosure is further directed to providing an electrospinning apparatus for producing ultrafine fibers and a solution transfer pump therefor which are electrically safely protected without an electric short of a control circuit unit caused by a short circuit under a high voltage environment.

Technical Solution

To achieve the above-described object, an electrospinning apparatus for producing ultrafine fibers according to a first embodiment of the present disclosure includes a high voltage supplier to apply high voltage to a spinning nozzle to charge a solution containing a dissolved polymer material, the spinning nozzle including at least one hollow needle to receive the charged solution and jet the charged solution in the form of filaments, a cylindrical metal guide positioned around the hollow needle at the lower end of the spinning nozzle, wherein high voltage is applied to the cylindrical metal guide to control droplet stability of the charged solution, and a collector positioned under the spinning nozzle to collect charged filaments.

In this instance, the cylindrical metal guide has a lower end positioned 1 mm or more and less than 5 mm higher than a tip of the hollow needle.

According to a second embodiment of the present disclosure, the electrospinning apparatus for producing ultrafine fibers further includes a strip-shaped metal guide including a plurality of strip-shaped metal plates radially arranged around the cylindrical metal guide and extending in a direction perpendicular to a nozzle arrangement direction.

In this instance, the plurality of metal plates may be arranged on a same plane, or arranged unevenly with different heights.

Additionally, the strip-shaped metal guide may be installed rotatably around the cylindrical metal guide.

Additionally, the cylindrical metal guide is coupled to a metal ring to which the high voltage is applied to adjust the height and ease the attachment and detachment.

According to a third embodiment of the present disclosure, the electrospinning apparatus for producing ultrafine fibers includes a plurality of spinning nozzles arranged at a preset interval and mounted in a pusher block fastened to a screw connected to an axis of a motor, to form cartridge type multiple channels, the cylindrical metal guide and the strip-shaped metal guide are individually positioned corresponding to each hollow needle, the strip-shaped metal guide extends in the direction perpendicular to the nozzle arrangement direction near the hollow needle of all the spinning nozzles that constitute the multiple channels, and the electrospinning apparatus for producing ultrafine fibers further includes a strip-shaped metal guide including a part extending in a direction parallel to the nozzle arrangement direction near the hollow needle of a channel disposed at two side ends among the multiple channels.

The part of the strip-shaped metal guide extending in the direction parallel to the nozzle arrangement direction near the hollow needle of the channel disposed at the two side ends among the multiple channels may be vertically bent and extend downwards.

The magnitude of high voltage applied by the high voltage supplier is (+)1 kV~(+)50 kV at a distance (cm) between the tip of the hollow needle and the collector of kV/cm~10 kV/cm.

A fourth embodiment of the present disclosure relates to a solution transfer pump of an electrospinning apparatus for producing ultrafine fibers including a spinning nozzle including at least one hollow needle to receive a charged solution and jet the charged solution in the form of filaments, and a cylindrical metal guide positioned around the hollow needle at a lower end of the spinning nozzle, wherein high voltage is applied to the cylindrical metal guide to control droplet stability of the charged solution.

In this instance, the cylindrical metal guide has the lower end positioned 1 mm or more and less than 5 mm higher than a tip of the hollow needle.

A fifth embodiment of the present disclosure relates to the solution transfer pump of an electrospinning apparatus for producing ultrafine fibers further including a strip-shaped metal guide including a plurality of strip-shaped metal plates radially arranged around the cylindrical metal guide and extending in a direction perpendicular to a nozzle arrangement direction.

In this instance, the plurality of metal plates may be arranged on a same plane or arranged unevenly with different heights. Additionally, the strip-shaped metal guide may be installed rotatably around the cylindrical metal guide.

According to a sixth embodiment of the present disclosure, the solution transfer pump of an electrospinning apparatus for producing ultrafine fibers includes a plurality of spinning nozzles arranged at a preset interval and mounted in a pusher block fastened to a screw connected to an axis of a motor, to form cartridge type multi-channels, the cylindrical metal guide and the strip-shaped metal guide are individually positioned corresponding to each hollow needle, the strip-shaped metal guide extends in a direction perpendicular to the nozzle arrangement direction near the hollow needle of all the spinning nozzles that constitute the multiple channels, and the solution transfer pump of an electrospinning apparatus for producing ultrafine fibers further includes a strip-shaped metal guide including a part extending in a direction parallel to the nozzle arrangement direction near the hollow needle of a channel disposed at two side ends among the multiple channels.

The part of the strip-shaped metal guide extending in the direction parallel to the nozzle arrangement direction near the hollow needle of the channel disposed at the two side ends among the multiple channels may be vertically bent and extend downwards.

Advantageous Effects

The electrospinning apparatus for producing ultrafine fibers having improved charged solution control structure according to the present disclosure and the solution transfer pump therefor have the following effects.

First, it is possible to overcome the spinning instability by controlling the sway of the charged solution formed at the nozzle tip in a high voltage environment of a few tens of thousands volts during electrospinning.

Second, the cylindrical metal guide and the strip-shaped metal guide are positioned around the hollow needle of the spinning nozzle to stably maintain the jet droplets of the charged solution, and the resulting charged filaments may maintain uniform orientation to form a uniform pattern (for example, a grid shaped pattern or circuit) of ultrafine fibers on the collector.

Third, it is possible to electrically safely protect the solution transfer pump in the electrospinning process by shutting off high voltage leaking from the syringe to the support plate or the case to prevent an electric short of the controller.

BRIEF DESCRIPTION OF THE DRAWINGS

The accompanying drawings illustrate preferred embodiments of the present disclosure, and together with the following detailed description, serve to provide further understanding of the technical spirit of the present disclosure. However, the present disclosure is not to be construed as being limited to the drawings.

FIG. 10 shows a still image in a video capturing droplets jetting from the nozzle tip of the nozzle components of example, comparative example 1 and comparative example 2.

DETAILED DESCRIPTION

Figure 1:
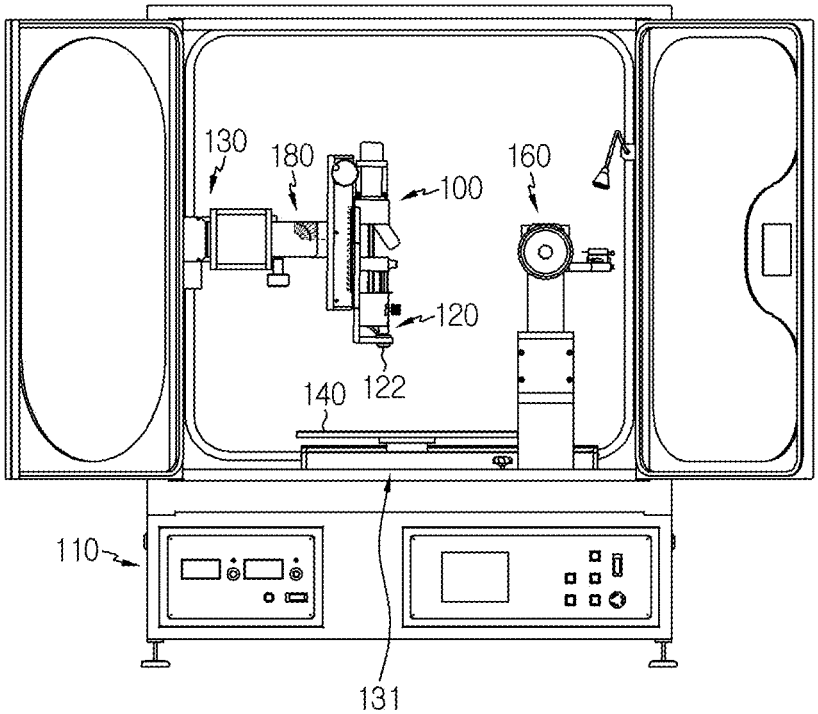
FIG. 1 is a front view of an electrospinning apparatus for producing ultrafine fibers according to a preferred embodiment of the present disclosure.

Hereinafter, the embodiments of the present disclosure will be described in more detail with reference to the accompanying drawings. The embodiments of the present disclosure may be modified in many forms, and the scope of the present disclosure should not be interpreted as being limited to the following embodiments. These embodiments are provided to help those skilled in the art to understand the present disclosure fully and completely. Although specific terms are used in the accompanying drawings and the present disclosure, this is used to describe the present disclosure, but not intended to limit the meaning or the scope of the present disclosure defined in the appended claims. Those skilled in the art will understand that a variety of modifications and equivalents may be made thereto. Therefore, the true technical protection scope of the present disclosure should be defined by the technical aspects of the appended claims.

The preferred embodiments of the present disclosure will be described in detail below with reference to the accompanying drawings. The accompanying drawings are not shown by the scale, and in each drawing, like reference numeral denotes like element.

Figure 2:
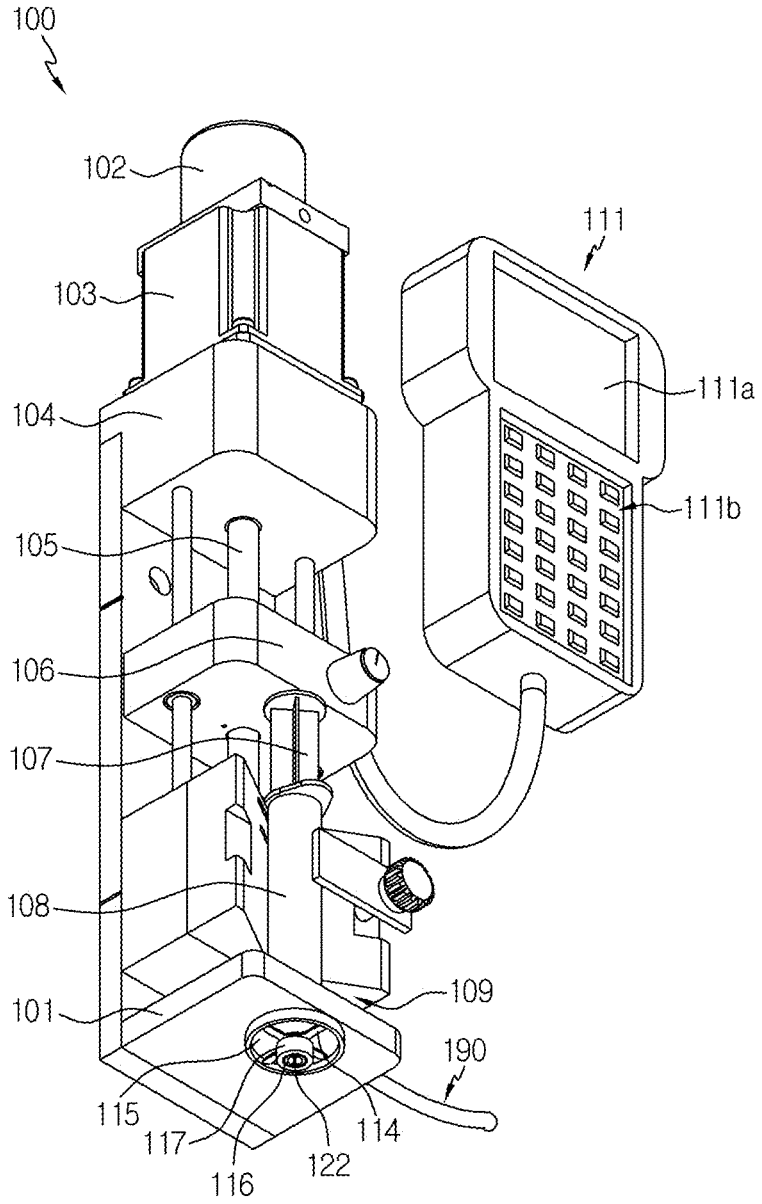
FIG. 2 is a perspective view of a solution transfer pump in FIG. 1.
Figure 3:
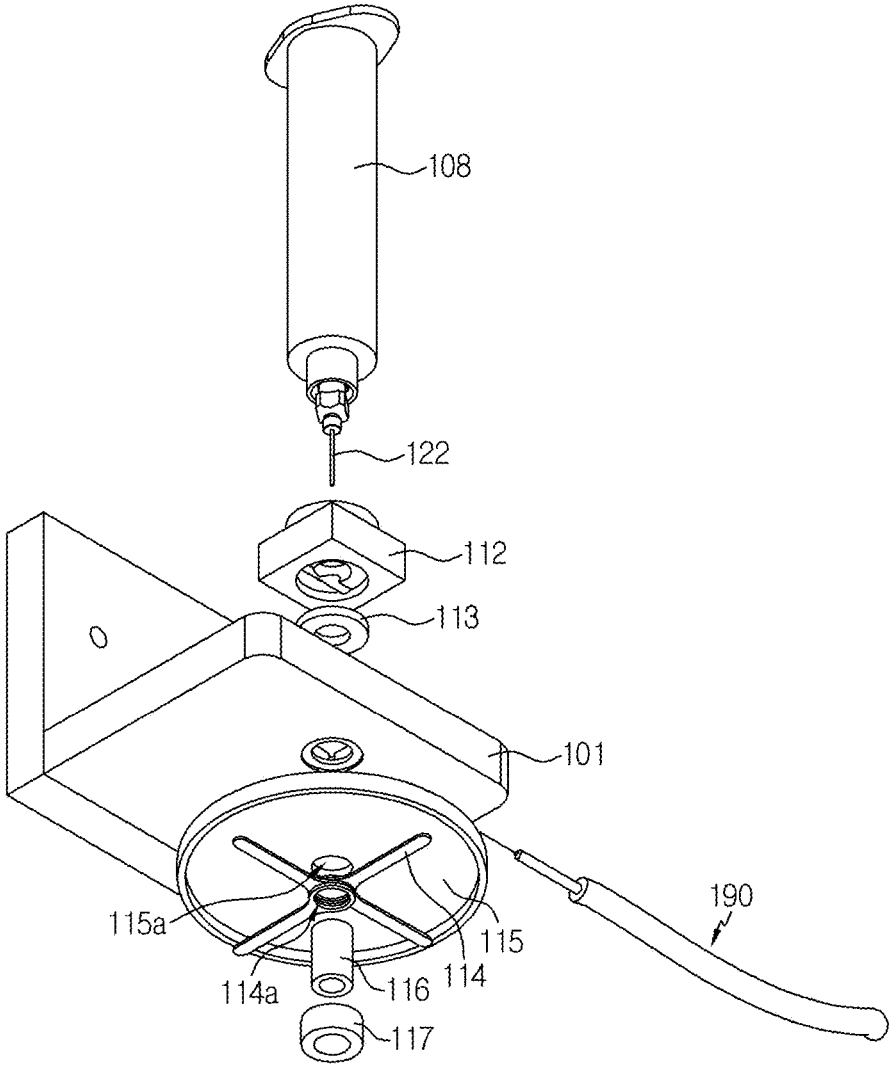
FIG. 3 is an exploded perspective view of a spinning nozzle and a charged solution control means in FIG. 2.
Figure 4:
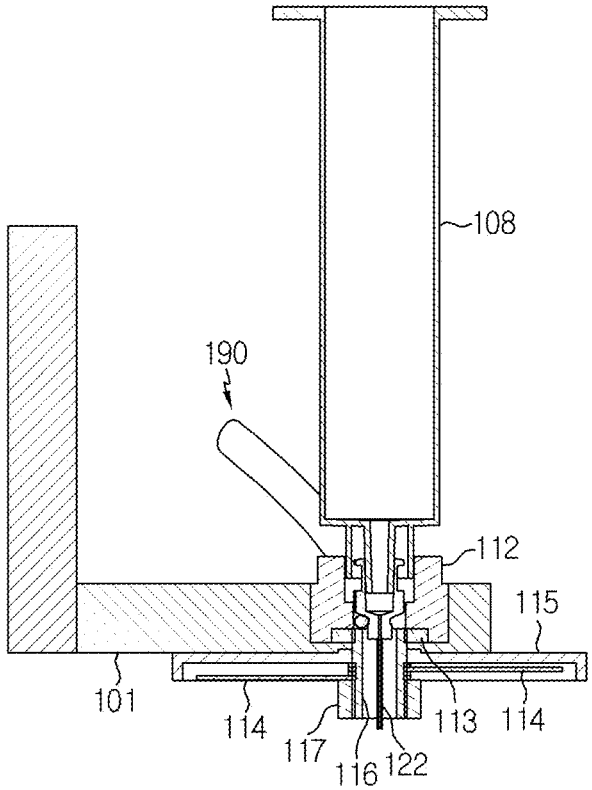
FIG. 4 is an assembled cross-sectional view of FIG. 3.

FIG. 1 is a front view of an electrospinning apparatus for producing ultrafine fibers according to a preferred embodiment of the present disclosure, FIG. 2 is a perspective view of a solution transfer pump in FIG. 1, FIG. 3 is an exploded perspective view of a spinning nozzle and a charged solution control means in FIG. 2, and FIG. 4 is an assembled cross-sectional view of FIG. 3.

Referring to FIGS. 1 to 4, the electrospinning apparatus for producing ultrafine fibers according to a preferred embodiment of the present disclosure includes a high voltage supplier 110 to apply a high voltage to the spinning nozzle 120, a solution transfer pump 100 to transfer the solution stored in a syringe 108 to the spinning nozzle 120, and a collector 140 to collect charged filaments. Additionally, the solution transfer pump 100 includes a spinning nozzle 120 to jet the charged filaments, and a cylindrical metal guide 116 and a strip-shaped metal guide 114 positioned below the spinning nozzle 120 to serve as means for controlling charged solution.

The syringe 108 preferably includes a barrel having the internal capacity of 100 μl~1,000 μl. A plunger 107 corresponding to a pusher stick is inserted into the barrel of the syringe 108. In the case of an internal storage tank without the plunger 107, the solution may be transferred by the air pressure. The syringe 108 is preferably made of an insulating material having high voltage resistance, for example, polypropylene (PP), polyethylene (PE), polyether ether ketone(PEEK), Nylon, acetal and glass. In the case of the barrel with a small thickness, dielectric breakdown may occur at high voltage in the electrospinning process, or electricity of the charged solution may be leaked at the connected part of the syringe 108, and thus it is preferable to use a cover of an insulating material outside of the barrel together.

The polymer solution fed into the syringe 108 may include a solution containing polymer dissolved in a solvent or a polymer solution containing conductive particles, the solvent including poly(vinylidene fluoride) (PVDF), poly (acrylonitile) (PAN), poly(vinylalcohol) (PVA), poly(imide) (PI), poly(ethylene oxide) (PEO), poly(lactic-co-glycolic acid (PLGA), polylactic acid (PLA), poly-L-lactic acid (PLLA), polyglycolic acid (PGA), polycarpro lactone (PCL), and chitosan.

When making a core-shell dual-layer structure, the shell solution may include the polymer solution, and the core solution may include a functional material such as oil. In this instance, the functional material may include drugs, conductive materials including silver (Ag) or carbon based particles, antimicrobial odor removing materials, fragrance microcapsules, electromagnetic shielding materials, infrared curable materials and oils.

The solution stored in the syringe 108 is transferred to the spinning nozzle 120. To this end, the solution transfer pump 100 includes a motor 103 such as a stepping motor or a servomotor to uniformly maintain a transfer amount of the solution.

The motor 103 is attached to a motor mounting block 104, and transmits power to a screw 105 through an insulation coupling. In this instance, the insulation coupling is positioned between the motor axis and the screw 105 to shut off a high voltage electric leakage through the screw 105. The motor 103 may include a stepping motor or a servomotor, and for a very small movement, it is more desirable to employ the stepping motor. An encoder 102 is attached to the rear surface of the motor 103 to detect the rotation of the motor. When the rotation of the screw 105 is stopped, for example, for 1-2 sec, the encoder 102 detects the rotation of the motor 103 and stops the motor 103 to prevent the overheat of the motor 103 caused by overload.

When the motor 103 of the solution transfer pump 100 works, a pusher block 106 attached to the screw 105 pushes the plunger 107 of the syringe 108 to transfer the solution in the barrel of the syringe 108 to the spinning nozzle 120.

The pusher block 106 for solution transfer is fastened to the screw 105, and moves forward or backward along a guide rod when the screw 105 rotates by the operation of the motor 103. The guide rod may be positioned on one or two sides near the screw 105. The pusher block 106 includes a nut (not shown) at the center to move by the movement of the screw 105. A spring is formed on one side of the nut so that the nut is coupled to or separated from the screw 105, and a cam rotor is assembled on the other side. As the cam rotor rotates, the nut is coupled to the screw 105 and the pusher block 106 moves forward. When the nut is separated from the screw 105, even though the screw 105 rotates, the pusher block 106 idle rotates. When the pusher block 106 moves forward, the plunger 107 of the syringe 108 moves forward. The lead of the screw 105 is 0.5 to 2 mm, and preferably 1 mm. The movement speed of the pusher block 106 preferably has the minimum speed of 1 μm/hr~100 μm/hr, and the maximum speed of 1 cm/min~20 cm/min. The pusher block 106 may be installed in and move along a linear block instead of the guide rod.

A syringe holder 109 that holds the syringe 108 is preferably made of an insulating material, for example, acetal or polyethylethylketone (PEEK), to shut off the current flowing out of the syringe 108.

The high voltage supplier 110 charges the solution in the high voltage by applying a high voltage to the spinning nozzle 120. The high voltage supplier 110 is a device that supplies the direct current power, and the direct current power is supplied to the solution through contact with the spinning nozzle 120. The direct current voltage applied to the spinning nozzle 120 is 0.01 kV/cm~10 kV/cm between the nozzle and the collector 140. The preferred voltage magnitude is 1 kV~50 kV at the distance between the nozzle (the tip of a hollow needle 122) and the collector 140 of 1 cm~30 cm. In the case of near-field electrospinning, the distance is preferably 0.1 cm to 2 cm, and the applied voltage is preferably 0.1 kV/cm~1.5 kV/cm. Magnitude of the high voltage may be appropriately adjust according to the type of the polymer, the viscosity of the polymer, the characteristics of the nozzle, and the shape of the circular plate provided in the nozzle for the production of ultrafine fibers or nanofibers from the charged solution jetting through the nozzle.

The high voltage generated from the high voltage supplier 110 is applied to the nozzle through a high voltage cable 190 connected to the spinning nozzle 120.

The spinning nozzle 120 includes at least one hollow needle 122 to receive the solution from the solution transfer pump 100 and thus jet the solution in the shape of filaments, and a nozzle holder 101 in which the hollow needle 122 is fixed. The hollow needle 122 preferably has the inner diameter of 0.01 mm~2 mm, the outer diameter of 0.02 mm~3 mm, and the length of 2 mm~100 mm.

The high voltage cable 190 is connected to the spinning nozzle 120, and has the metal conductor that comes into contact with the nozzle body to apply the high voltage. The high voltage is applied to the solution through the contact between the metal conductor and the nozzle. The material of the metal conductor is preferably stainless steel (SUS), copper or brass. In the case of a corrosive solution, the SUS is more suitable.

The support plate or the support case disposed on the rear surface of the solution transfer pump 100 is made of metal or PEEK as an insulating material. Additionally, an installation region of the syringe holder 109 that holds the syringe 108 may be made of an insulating material, or may have an insulating material cover, or may be coated with an insulating material. The insulating material cover or the coating material is preferably an insulating material, for example, Teflon or PEEK or silicone rubber.

The syringe holder 109 is preferably made of an insulating material, for example, polyethylethylketone (PEEK) or acetal, to shut off the current flowing out of the storage tank.

The cylindrical metal guide 116 and the strip-shaped metal guide 114 positioned below the spinning nozzle 120 as the charged solution control means serve to stabilize the droplets of the charged solution and control the direction of charged filaments formed from the droplets. The high voltage applied to the charged solution control means may be supplied from the same voltage source as the high voltage supplied to the spinning nozzle 120 to charge the solution, and alternatively, the high voltage may be separately supplied from another voltage source. Additionally, the high voltage supplied to the cylindrical metal guide 116 and the strip-shaped metal guide 114 to control the charged solution may have the same volt (V) value, and the voltage may be individually supplied with different volt (V) values.

The cylindrical metal guide 116 serves to prevent the swing of the droplets of the charged solution in order to achieve stability. To prevent the swing of the droplets of the charged solution more effectively, the lower end of the cylindrical metal guide 116 is preferably positioned 1 mm or more and less than 5 mm higher than the tip of the hollow needle 122. The cylindrical metal guide 116 is placed such that the hollow needle 122 coupled to the syringe 108 is disposed at the center, and is disposed higher than the hollow needle 122 such that the hollow needle 122 substantially extends downwards.

As shown in FIG. 4, the cylindrical metal guide 116 is fastened to a metal ring 113 that is inserted into the nozzle holder 101 and disposed on the nozzle holder 101. The metal ring 113 is coupled to the lower part of a syringe front end holder 112, and is electrically connected in contact to the high voltage cable 190. The cylindrical metal guide 116 has the inner diameter of 3~10 mm, and the outer diameter of 4~15 mm. More preferably, the inner diameter is 4~8 mm, and the outer diameter is 6~12 mm. A guide cap 117 of an insulating material such as polyethylethylketone (PEEK) is preferably positioned outside of the cylindrical metal guide 116 to prevent leakage of high voltage to the outside.

A plurality of strip-shaped metal guides 114 outwardly extends in radial direction from the cylindrical metal guide 116. The strip-shaped metal guide 114 preferably is composed of 1~4 metal plate formed in the thin and long strip. The strip-shaped metal guide 114 is coupled to the cylindrical metal guide 116, and outwardly extends in radial direction of the cylindrical metal guide 116. The strip-shaped metal guide 114 may be attached and fixed to a disc-shaped support plate 115. When the plurality of strip-shaped metal guides 114 is installed, the plurality of strip-shaped metal guides 114 may be arranged on the same plane on the support plate 115, and alternatively, the plurality of strip-shaped metal guides 114 may be positioned with different heights on the support plate 115, thereby controlling the direction of the spun filaments more variously.

The strip-shaped metal guide 114 may be installed rotatably around the cylindrical metal guide 116 to control the direction of the spun filaments. In this instance, the plurality of strip-shaped metal guides 114 can be rotated independently or integrally. The strip-shaped metal guide 114 adjusts the installation location by rotation around the cylindrical metal guide 116, and thus control the orientation of the spun filaments jetting from the hollow needle 122. The strip-shaped metal guide 114 may be coupled to and rotate integrally with the cylindrical metal guide 116. The strip-shaped metal guide 114 is preferably 2~5 mm in width, 10~50 mm in length and 0.1~2 mm in thickness. The material is preferably SUS and aluminum.

In the case that the strip-shaped metal guides 114 is composed of the plurality of metal plate, the strip-shaped metal guides 114 may be radially arranged at a preset interval and integrally formed. In this case, preferably, a fastening hole 114*a* having a screw thread on the inner walls is provided at the center, and the cylindrical metal guide 116 is screw-coupled to the fastening hole 114*a*. The cylindrical metal guide 116 is inserted into the fastening hole 114*a* and mounted on the nozzle holder 101 through a central hole 115*a* provided at the center of the support plate 115. The upper part of the cylindrical metal guide 116 goes through the nozzle holder 101 and is coupled to the metal ring 113.

Figure 5:
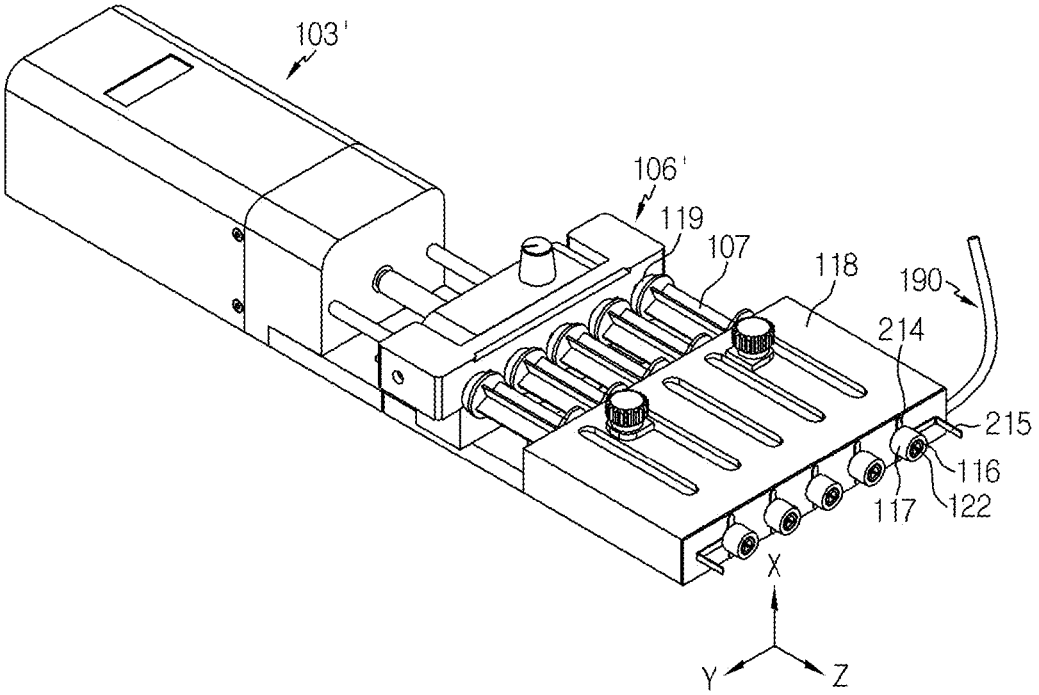
FIG. 5 is a perspective view of a cartridge type multi-channel solution transfer pump provided according to another embodiment of the present disclosure.

A plurality of solution transfer pumps 100 provided according to the present disclosure may be arranged at the preset interval and mounted on a pusher block 106' coupled to a screw connected to the axis of a motor 103' to form cartridge type multiple channels. In this case, as shown in FIG. 5, the cylindrical metal guide 116 and strip-shaped metal guides 214, 215 are arranged individually around each hollow needle 122 that forms the multiple channels.

The strip-shaped metal guides 214, 215 include a first strip-shaped metal guide 214 extending in a direction (X axis direction) perpendicular to the nozzle arrangement direction, and a second strip-shaped metal guide 215 which is disposed at two side ends of the multiple channels and extends in a direction (Y axis direction) parallel to the nozzle arrangement direction. Here, the second strip-shaped metal guide 215 located at the two side ends of the multiple channels performs a function to prevent the spun filaments jetting from the hollow needle 122 from spreading in the outward direction. More preferably, when the second strip-shaped metal guide 215 is vertically bent and extends downwards (Z axis direction), it is possible to prevent the spun filaments from spreading outwards more effectively.

In applying high voltage to the nozzles of the multiple channels, high voltage is applied when the metal conductor of the high voltage cable 190 comes into contact with a nozzle hub installed within a syringe holder 118. When each syringe 108 of all the nozzles of the multiple channels are filled in different amounts, all of the plunger 107 does not touch the pusher block 106' and cannot simultaneously push the pusher block 106', and thus it is desirable to install a screw plate 119 for distance adjustment in the pusher block 106', and transfer the solution after adjusting the distance from the plunger 107.

All the nozzles that form the multiple channels are kept in parallel arrangement state while being all together held by the single nozzle holder 118.

Figure 6:
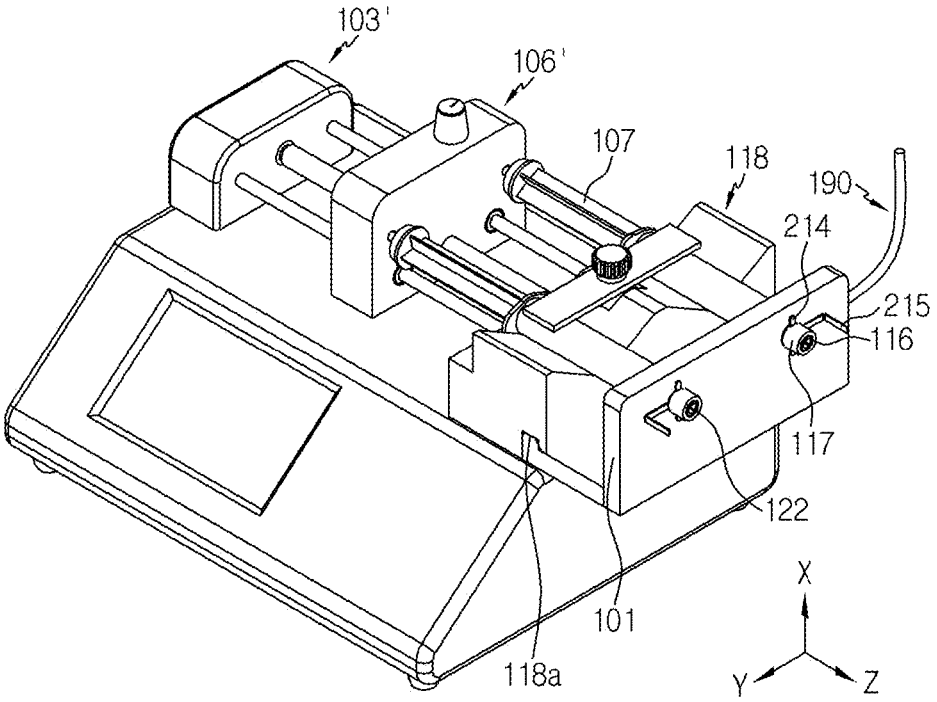
FIG. 6 is a perspective view of a two-channel solution transfer pump provided according to a variation of FIG. 5.

The solution transfer pump 100 provided according to the present disclosure may be modified into duel type of two-channel to form a cartridge when mounted in the pusher block 106' fastened to the screw connected to the axis of the motor 103'. As shown in FIG. 6, the cylindrical metal guide 116 is positioned around each hollow needle 122 that forms the two-channel. The first strip-shaped metal guide 214 extends in a direction (X axis direction) perpendicular to the nozzle arrangement direction around the cylindrical metal guide 116 to control the direction of the charged filaments(or the spun filaments) jetting from the nozzle tip. Additionally, the second strip-shaped metal guide 215 includes its part extending in a direction (Y axis direction) parallel to the nozzle arrangement direction. Here, the second strip-shaped metal guide 215 serves to control the orientation to prevent the charged filaments jetting the hollow needle 122 from spreading in the outward direction, and when another part of the second strip-shaped metal guide 215 is vertically bent and extends down (Z axis direction), it is possible to prevent the charged filaments from spreading outwards more effectively.

In the duel type of two-channel, the nozzle holder 101 may be installed by forming a groove 118*a* in the lower end of the syringe holder 118 which holds the syringe 108, and laterally pushing the nozzle holder 101 into the groove 118*a* of the syringe holder 118 in a sliding manner.

The collector 140 is positioned under the spinning nozzle 120 to collect the charged filaments. The collector 140 may be formed of a flat plate or a conveyor, or may be formed of a conveyor including a plurality of rolls having the diameter of 5 mm~50 mm or a plurality of rods having the outer diameter of 1 mm~5 mm, or a combination thereof. Additionally, a drum-type rotator 160 may be added to collect the charged filaments.

For a continuous process, the plurality of rolls or the plurality of rod is desirable as collector. The collector 140 is connected to the ground or (−) direct current voltage. When the ground is connected to the collector 140, an electric field is formed between the nozzle and the collector 140 to create an electrospinning environment.

Robot actuators 130, 131 repeatedly make reciprocating movements in the horizontal or vertical direction of the collector 140 to uniformly collect the spun ultrafine fibers on the collector 140 of a predetermined size. An angle adjuster 180 is preferably provided at the front end of the robot actuators 130, 131 to adjust the spinning angle in order to achieve vertical spinning or horizontal spinning.

A controller 111 includes a screen 111*a* and a button 111*b* for input of numbers and functions. The screen 111*a* displays the start point and the end point of the X axis and Y axis of the robot actuators 130, 131, the robot operation speed, the rotator speed, the jet quantity during the operation of the solution supplier, the total jet quantity, the flow rate, the syringe diameter and the syringe capacity. The button 111*b* for input numbers and functions may input the number of X axis lines of the robot actuators 130, 131 and the movement distance between Y axis steps, and includes a motor power ON/OFF button of the solution supplier, a flow rate control button, a flow rate control re-start button, a jog button for high speed operation of the motor and a previous step movement button. When pressed, the flow rate control button is configured to select the total jet quantity of the solution, the flow rate control unit, the flow rate control quantity, the syringe for each manufacturer and the capacity of the syringe of the selected manufacturer, directly input the inner diameter of the syringe, select the flow rate control unit from any one of nanoliter (nl)/min, microliter (μl)/min or milliliter (ml)/hr, select whether to use the function of the encoder 102, and when a malfunction occurs in the encoder 102, stop the function to continuously operate only the motor.

The electrospinning apparatus according to the present disclosure may include a high voltage generator to apply (−) polarity instead of the ground to the collector 140. Additionally, the electrospinning apparatus may include an imaging system to monitor the spinning condition of the Taylor cone formed from the charged solution at the nozzle tip in real time and store it as a video or an image.

To produce nanofibers according to the present disclosure, the jet quantity of the solution is preferably set to 0.05 μl/min~500 μl/min per nozzle hole. The more preferable jet quantity of the solution is 0.2 μl/min~50 μl/min.

Using the electrospinning apparatus according to the present disclosure, the Taylor cone formed at the nozzle tip keeps it stable while forming a jet in the lengthwise direction. The Taylor cone and the jet are kept in stable state without inclined orientation at the nozzle tip in a high voltage environment of 10 kV or more. The jet of the charged filaments may form ultrafine fibers on a substrate such as a metal plate as well as a film, a fabric, a texture, a non-woven fabric, a paper, a metal plate, a glass plate and a ceramic plate. Additionally, the jet elongated in higher voltage forms ultrafine fibers of micro to nano size from a specific point through severe fluctuations and the solvent volatilization process. The produced ultrafine fibers are collected in the grounded collector to produce a membrane.

The electrospinning apparatus for producing ultrafine fibers according to the present disclosure is used to produce a nanofiber web as well as a miroporous membrane, hollow nanofibers, scaffolds for cell culture and circuits based on ultrafine fibers.

Experimental Example 1

Comparative analysis is conducted on the stability of droplets at the nozzle tip vs the high voltage magnitude and the jet quantity of nozzle components of example according to the present disclosure and nozzle components according to comparative example.

(1) Example

Figure 7:
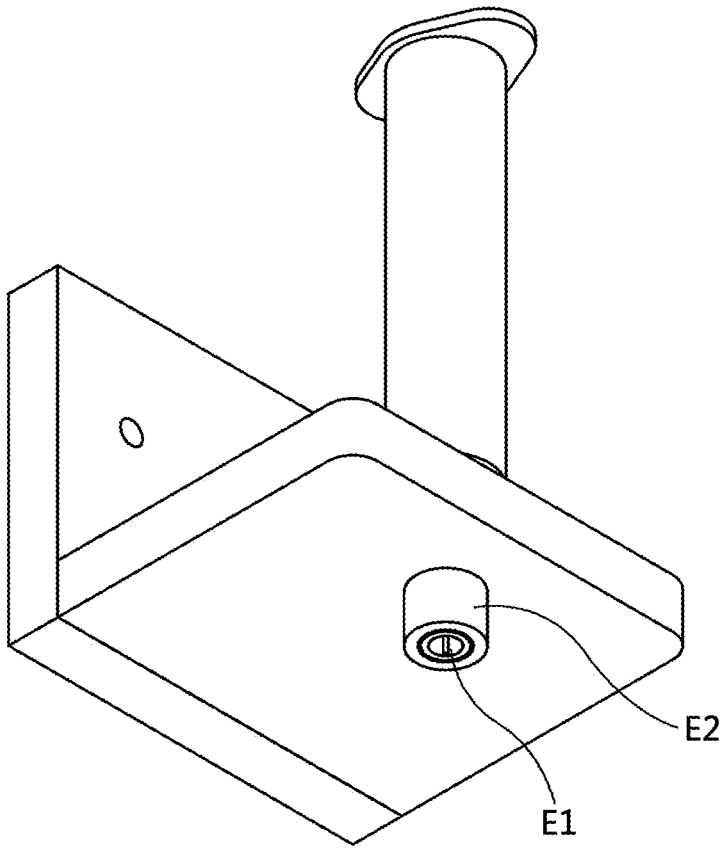
FIG. 7 is a schematic diagram of nozzle components according to an embodiment of the present disclosure.

As shown in FIG. 7, high voltage is applied to a spinning nozzle mounted in a syringe by contact with a metal conductor of high voltage cable for applying high voltage provided in a nozzle holder, the nozzle E1 is disposed at the center of a cylindrical metal guide E2, and the nozzle tip is disposed 1.6 mm longer than the lower end of the cylindrical metal guide E2. A collector is a flat SUS metal plate, and the distance between the nozzle tip and the SUS metal plate is 110 mm. A spinning solution is prepared using [poly) vinylidenefluoride (PVDF), Arkema Kynar 2801] polymer and a mixed solvent of acetone:diimethylacetamide (DMAc) 7:3 at the solution concentration of 17 weight %. The spinning solution is put into 10 ml syringe, and a hollow needle (23G (the inner diameter 0.33 mm)) is connected to the outlet of the syringe and mounted in a solution transfer pump.

(2) Comparative Example 1

Figure 8:
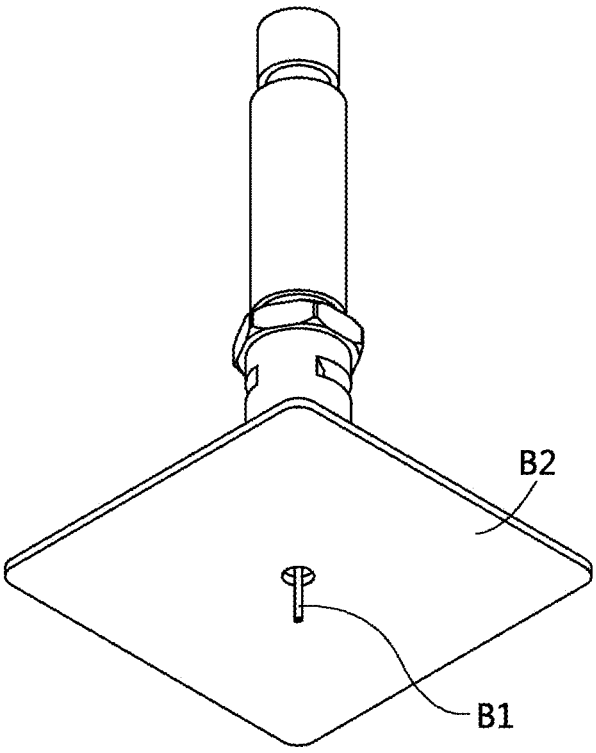
FIG. 8 is a schematic diagram of nozzle components according to comparative example 1.

As shown in FIG. 8, high voltage is applied to a spinning nozzle mounted in a syringe by contact with a metal conductor of high voltage cable for applying high voltage provided in a nozzle holder, the nozzle B1 is disposed at the center of a charge distribution plate (a conducting plate) B2, and the nozzle tip is disposed 5 mm longer than the lower end of the charge distribution plate (the conducting plate) B2. For the material of the charge distribution plate B2, a stainless steel SUS 304 metal plate (45 mm×45 mm) is used. Additionally, a collector is a flat SUS metal plate, and the distance between the nozzle tip and the SUS metal plate is 110 mm. A spinning solution is prepared using [(poly) vinylidenefluoride (PVDF), Arkema Kynar 2801] polymer and a mixed solvent of acetone:dimethylacetamide (DMAc) 7:3 at the solution concentration of 17 weight %. The spinning solution is put into 10 ml syringe, and a hollow needle (23G (the inner diameter 0.33 mm)) is connected to the outlet of the syringe and mounted in a solution transfer pump.

(3) Comparative Example 2

Figure 9:
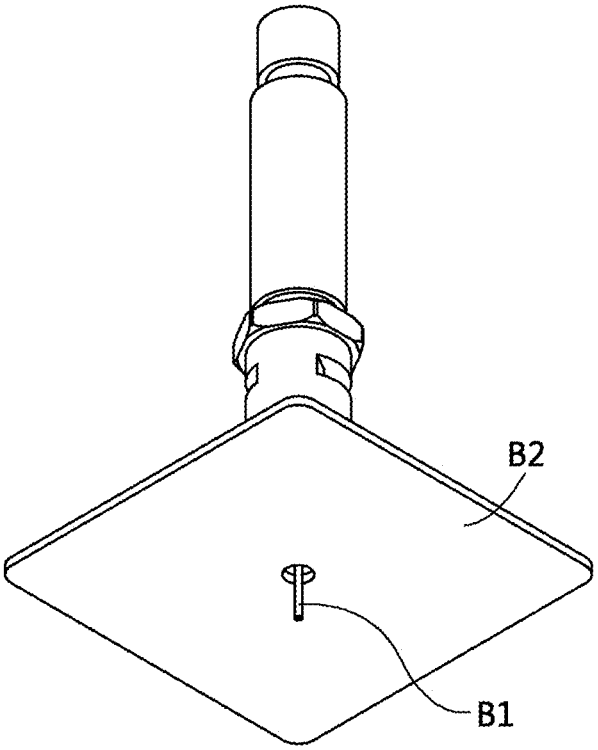
FIG. 9 is a schematic diagram of nozzle components according to comparative example 2.

As shown in FIG. 9, high voltage is applied to a spinning nozzle mounted in a syringe by contact with a metal conductor of high voltage cable for applying high voltage provided in a nozzle holder, the nozzle B1 is disposed at the center of a charge distribution plate (a conducting plate) B2, and the nozzle tip is disposed 10 mm longer than the lower end of the charge distribution plate (the conducting plate) B2. For the material of the charge distribution plate B2, a stainless steel SUS 304 metal plate (45 mm×45 mm) is used. Additionally, a collector is a flat SUS metal plate, and the distance between the nozzle tip and the SUS metal plate is 110 mm. A spinning solution is prepared using [(poly) vinylidenefluoride (PVDF), Arkema Kynar 2801] polymer and a mixed solvent of acetone:dimethylacetamide (DMAc) 7:3 at the solution concentration of 17 weight %. The spinning solution is put into 10 ml syringe, and a hollow needle (23G (the inner diameter mm)) is connected to the outlet of the syringe and mounted in a solution transfer pump.

FIG. 10 shows a still image in a video capturing droplets jetting from the nozzle tip of the nozzle components of example, comparative example 1 and comparative example 2.

As can be seen from FIG. 10, the nozzle components of example provide a stability effect of droplets at the nozzle tip for each nozzle due to the cylindrical metal guide positioned around the circumference of the individual nozzle. Accordingly, the electrospinning apparatus according to the present disclosure can generate lines of charged filaments with stability and orientation, failing to form a pattern such as a grid-shape membrane. In contrast, the nozzle components of comparative example 1 and comparative example 2 do not form stable droplets at the nozzle tip, failing to generate a regular line and produce a pattern such as a grid-shaped membrane.

Experimental Example 2

Experimental example 2 uses the electrospinning apparatus shown in FIG. 1.

A spinning solution is a transparent solution prepared using [(poly)vinylidenefluoride (PVDF), Arkema Kynar 2801] polymer and a mixed solvent of acetone:dimethylacetamide (DMAc) 7:3 at the solution concentration of 17 weight %. The spinning solution is put into the 10 ml syringe 108 having the solution outlet of a luerlock structure in which the pusher stick-shaped plunger 107 is mounted, and a hollow needle 122 is connected to the outlet of the syringe 108 and mounted in the solution transfer pump 100.

In this instance, high voltage is applied to the spinning nozzle 120 mounted in the syringe 108 by contact with the metal conductor of high voltage cable for applying high voltage provided in the nozzle holder 101. The nozzle is disposed at the center of the cylindrical metal guide 116, and the nozzle tip is disposed 2 mm longer than the lower end of the cylindrical metal guide 116. The strip-shaped metal guide 114 is installed around the cylindrical metal guide 116. Electrospinning is performed by the operation of the motor 103 under the applied high voltage. Each experiment is performed with the high voltage magnitude of 12.8 kV. The jet quantity of the solution is 25 μl/min, and the collector is a flat SUS metal plate. The distance between the nozzle tip and the SUS plate is 125 mm. Nanofibers are collected in the SUS collector.

As a result, when the cylindrical metal guide 116 and the strip-shaped metal guide 114 are used, stable spinning at the nozzle tip is achieved, and the nanofibers are uniformly collected in the limited area. However, when the cylindrical metal guide 116 and the strip-shaped metal guide 114 are not used, it fails to appropriately collect at a desired area of the collector due to the inclined spinning direction at the nozzle tip.

Accordingly, it can be seen that when the cylindrical metal guide 116 and the strip-shaped metal guide 114 subjected to high voltage are installed, it is possible to stabilize the droplets formed at the nozzle tip.

Although the electrospinning apparatus according to the present disclosure and the solution transfer pump using the same have been hereinabove described herein and shown in the accompanying drawings, this is provided by way of illustration and the aspects of the present disclosure are not limited to the description and drawings, and a variety of modifications and changes will be made without departing from the technical aspects of the present disclosure.

Additionally, it is obvious to those skilled in the art that many substitutions, modifications and changes may be made to the present disclosure without departing from the technical aspects of the present disclosure, and the present disclosure is not limited to the disclosed embodiments and the accompanying drawings.

What is claimed is:

1. An electrospinning apparatus for producing ultrafine fibers, comprising:

a high voltage supplier to apply high voltage to a spinning nozzle to charge a solution containing a dissolved polymer material;

the spinning nozzle including at least one hollow needle to receive the charged solution and jet the charged solution in the form of filaments;

a cylindrical metal guide positioned around the hollow needle at a lower end of the spinning nozzle, wherein high voltage is applied to the cylindrical metal guide to control droplet stability of the charged solution; collector positioned under the spinning nozzle to collect charged filaments; and a strip-shaped metal guide including a plurality of strip-shaped metal plates radially arranged around the cylindrical metal guide and extending in a direction perpendicular to a nozzle arrangement direction.

2. The electrospinning apparatus for producing ultrafine fibers according to claim 1, wherein the cylindrical metal guide has a lower end positioned 1 mm or more and less than 5 mm higher than a tip of the hollow needle.

3. The electrospinning apparatus for producing ultrafine fibers according to claim 2, wherein the plurality of metal plates is arranged on a same plane.

4. The electrospinning apparatus for producing ultrafine fibers according to claim 2, wherein the plurality of metal plates is arranged unevenly with different heights.

5. The electrospinning apparatus for producing ultrafine fibers according to claim 3, wherein the strip-shaped metal guide is installed rotatably around the cylindrical metal guide.

6. The electrospinning apparatus for producing ultrafine fibers according to claim 2, wherein the cylindrical metal guide is coupled to a metal ring to adjust the height and ease an attachment and detachment and the metal ring is applied the high voltage.

7. The electrospinning apparatus for producing ultrafine fibers according to claim 2, wherein a plurality of spinning nozzles is arranged at a preset interval and mounted in a pusher block fastened to a screw connected to an axis of a motor, to form cartridge type multiple channels, the cylindrical metal guide and the strip-shaped metal guide are individually positioned corresponding to each hollow needle, the strip-shaped metal guide extends in the direction perpendicular to the nozzle arrangement direction near the hollow needle of all the spinning nozzles that constitute the multiple channels, and wherein the electrospinning apparatus for producing ultrafine fibers further comprises another strip-shaped metal guide including a part extending in a direction parallel to the nozzle arrangement direction near the hollow needle of a channel disposed at two side ends among the multiple channels.

8. The electrospinning apparatus for producing ultrafine fibers according to claim 7, wherein the part of the strip-shaped metal guide extending in the direction parallel to the nozzle arrangement direction near the hollow needle of the channel disposed at two side ends among the multiple channels is vertically bent and extends downwards.

9. The electrospinning apparatus for producing ultrafine fibers according to claim 2, wherein a magnitude of high voltage applied by the high voltage supplier is kV/cm-10 kV/cm at a distance (cm) between a tip of the hollow needle and the collector and voltage applied by the high voltage supplier is (+) 1 kV-(+)50 kV.

10. A solution transfer pump of an electrospinning apparatus for producing ultrafine fibers, comprising:

a spinning nozzle including at least one hollow needle to receive a charged solution and jet the charged solution in the form of filaments;

a cylindrical metal guide positioned around the hollow needle at a lower end of the spinning nozzle, wherein high voltage is applied to the cylindrical metal guide to control droplet stability of the charged solution; and a strip-shaped metal guide including a plurality of strip-shaped metal plates radially arranged around the cylindrical metal guide and extending in a direction perpendicular to a nozzle arrangement direction.

11. The solution transfer pump of an electrospinning apparatus for producing ultrafine fibers according to claim 10, wherein the cylindrical metal guide has the lower end positioned 1 mm or more and less than 5 mm higher than a tip of the hollow needle.

12. The solution transfer pump of an electrospinning apparatus for producing ultrafine fibers according to claim 11, wherein the plurality of metal plates is arranged on a same plane.

13. The solution transfer pump of an electrospinning apparatus for producing ultrafine fibers according to claim 11, wherein the plurality of metal plates is arranged unevenly with different heights.

14. The solution transfer pump of an electrospinning apparatus for producing ultrafine fibers according to claim 12, wherein the strip-shaped metal guide is installed rotatably around the cylindrical metal guide.

15. The solution transfer pump of an electrospinning apparatus for producing ultrafine fibers according to claim 11, wherein a plurality of spinning nozzles is arranged at a preset interval and mounted in a pusher block fastened to a screw connected to an axis of a motor, to form cartridge type multi-channels, the cylindrical metal guide and the strip-shaped metal guide are individually positioned corresponding to each hollow needle, the strip-shaped metal guide extends in a direction perpendicular to the nozzle arrangement direction near the hollow needle of all the spinning nozzles that constitute the multiple channels, and wherein the solution transfer pump of an electrospinning apparatus for producing ultrafine fibers further comprises another strip-shaped metal guide including a part extending in a direction parallel to the nozzle arrangement direction near the hollow needle of a channel disposed at two side ends among the multiple channels.

16. The solution transfer pump of an electrospinning apparatus for producing ultrafine fibers according to claim 15, wherein the part of the strip-shaped metal guide extending in the direction parallel to the nozzle arrangement direction near the hollow needle of the channel disposed at the two side ends among the multiple channels is vertically bent and extends downwards.

17. The electrospinning apparatus for producing ultrafine fibers according to claim 4, wherein the strip-shaped metal guide is installed rotatably around the cylindrical metal guide.

18. The solution transfer pump of an electrospinning apparatus for producing ultrafine fibers according to claim 13, wherein the strip-shaped metal guide is installed rotatably around the cylindrical metal guide.

* * * * *